United States Patent [19]

Liu

[11] Patent Number: 4,939,349

[45] Date of Patent: Jul. 3, 1990

[54] CERAMIC THERMISTOR HEATING ELEMENT

[75] Inventor: Chi Liu, Annandale, Va.

[73] Assignee: Uppermost Electronic Industries Co., Ltd., Kaohsiung, Taiwan

[21] Appl. No.: 370,719

[22] Filed: Jun. 23, 1989

[51] Int. Cl.[5] ..... H05B 3/10

[52] U.S. Cl. ..... 219/552; 219/504

[58] Field of Search ..... 219/222, 520, 525, 530, 219/537, 532, 540, 543, 548, 552, 553, 367, 370, 374–376, 504, 505

[56] References Cited

U.S. PATENT DOCUMENTS 4,162,395 7/1979 Kobayashi ..... 219/537

4,327,282 4/1982 Nauerth ..... 219/549

*Primary Examiner*—Roy N. Envall, Jr.

*Attorney, Agent, or Firm*—Joseph P. Nigon

[57] ABSTRACT

A building block-like PTC thermistor heating element is disclosed which comprises a ceramic semiconductor body having a positive temperature coefficient of resistance. The partition walls of the building block-like ceramic body provide the passages of the air flow. Ohmic electrodes are deposited on the opposite side of the major surface of the ceramic body so that when connected to an electrical source the electrical current flows across the partition walls in a direction normal to the axis of the air flow. The building block-like thermistor is very easy to fabricate and is very strong in structure so that high yield and improved mechanical strength can be achieved.

5 Claims, 2 Drawing Sheets

CERAMIC THERMISTOR HEATING ELEMENT

FIELD OF THE INVENTION

The invention relates to a building block like heating element and more particularly to a heating element comprised of a ceramic semi-conductor body having a positive temperature coefficient of resistance (hereinafter referred to as PTC). The article is of rigid generally rectangular configuration and is characterized by relatively thick outer walls with rectangular channels therebetween. Each of the opposed surfaces of the article have an electrically conductive surface layer. Each of the surface layers is adapted and constructed to be connected to a source supplying electrical power to the semi-conductor article. The invention also includes a heater structure which is particularly useful in preparing air heaters, dryers, air towels, humidifiers and the like.

BACKGROUND OF THE INVENTION

The prior art devices used for resistance heating frequently used metals or ceramics having a positive temperature coefficient of electrical resistance. The metals are normally used a linear form in the heating element. When the element is used in a drier e.g. a hair dryer for example, a fan moves the air through the heating element. One of the obvious problems with structures of this type is the tendency of the heating element to overheat and the metal to become oxidized and broken.

The prior art ceramic articles utilize a honeycomb like structure. The structure has thin walls that are crosslinked to each other. Although this configuration gives satisfactory results when these elements are positioned in a heater, the elements are difficult to make by the dry pressing method and are generally extruded. Special care must be exercised in preparing the elements due, to the thickness of the partition walls. The building blocks configuration of the application provides thick walls without crossover linking to each other. The column shaped channels formed by the thick walls yield eliminate the processing difficulties. Higher yield can be achieved by either dry pressing or extruding.

A search of the prior art relating to PTC ceramic heating elements has resulted in noting the following U.S. patent numbers:

Group A. 3,927,300; 3,982,100; 4,232,214; 4,614,510.

Group B. 4,180,509; 4,189,901; 4,189,700; 4,264,888; 4,570,046; 4,717,813.

In applicant's view the prior art references in Group A are signifigant in that they describe and claim ceramic PTC devices. However, each of these patents utilize the honeycomb configuration. The patents in Group B are of more secondary interest. They also utilize the honeycomb configuration and in most cases require that the inner walls of the honeycomb be coated. These references known to the applicant are called to the attention of the Patent Office.

SUMMARY OF THE INVENTION

The invention is based on the recognition that the PTC ceramic element composed of a generally rigid rectangular structure characterized by thick outer walls with rectangular channels therebetween avoids the problems inherent in preparing the ceramic structures in the honeycomb configurations.

The principle object of the invention therefore is to provide a heating element comprising a PTC ceramic article having a building block configuration.

Another object of the invention is to provide a heater which includes a heating element comprising a PTC ceramic article composed of a building block body and useful as a heating element in various types of air heaters.

Another object of this invention is to provide a method of producing the heating element and to provide a method of forming the electrodes thereon. Other object of the invention will become apparent from the description and the drawings.

DESCRIPTION OF THE PREFERRED EMBODIMENT

Figure 1:
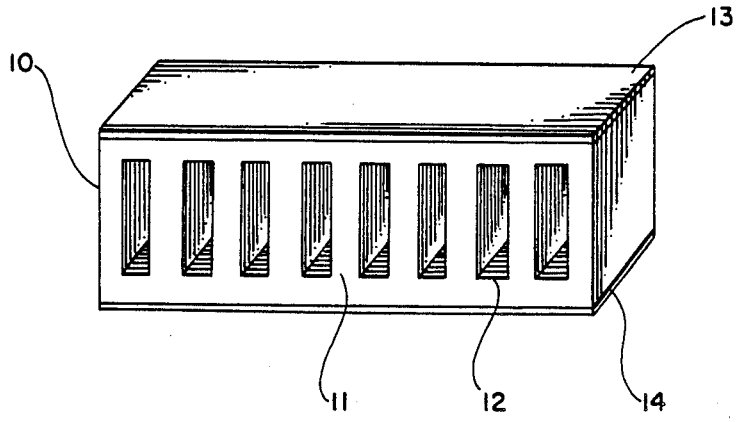
FIG. 1 is a perspective view of the preferred embodiment of the heating element of this invention.

Referring now to FIG. 1 which shows the ceramic heating element having the generally rigid rectangular configuration characterized by thick outer walls 11 having rectangular channels 12 therebetween. The building block configuration provides thick walls without cross-linking to each other and avoids the problem with the honeycomb like structures of the prior art. The channels formed by the thick walls eliminate a processing difficulty. Higher yields can be achieved by either dry pressing or extruding.

In the preferred method of producing the heating element of the invention a commercially available barium titanate powder, a binder and water were mixed to form a slurry. The resulting slurry was spray dried in a commercial spray dryer to prepare granules. The granules were pressed in a mold having the building block configuration of the device of the instant application. The green body was sintered in an electric furnace at a temperature of about 1000° to 1500° C. for about two hours.

In alternate procedure the mixture of barium titanate, binder and water can be extruded through a forming nozzle to provide a green body having the configuration of the ceramic body of the instant invention. In this procedure the extruded green body is sintered at a temperature of 1000° to 1500° C. in an electric furnace for a period of about two hours. A thermistor heating element 31mm in length and 11 mm in height was prepared using the preferred method described above. The element has eight channels 6 mm long and 3 mm wide separated from each other by a distance of 2 mm.

The ceramic compositions are not restricted to the above described barium titanate composition. Any other ceramic composition which can obtain a positive temperature coefficent of electrical resistance may be used.

The next step of the process of is the deposition of the electrodes. The electrodes can be deposited on the surfaces designated 13 and 14 of FIG. 1 for example or parallel to the axial direction of air flow without causing a significant increase in the electrical resistance. When the electrodes are deposited on the surfaces axial to the direction of air flow, the flat surface allows the direct use of flame spraying, brush painting, screen painting or dipping.

Thus in forming the ohmic electrodes the outer surfaces of the device in the building block configuration it is preferrable to use the silver paste baking method or the aluminum hot spraying method. In the silver paste baking method the silver paste is coated on the flat surfaces, e.g. 13 and 14 in FIG. 1 for example. The silver paste is available from E.I. DuPont de Nemours Co, or other suppliers. It is preferrable to use a silver paste containing indium or gallium. In the silver paste method, after coating is completed the device is baked in a temperature of about 500° to 900°C.

The alumium hot spray method of applying the ohmic electrode is preferred because of the problems inherent in the silver paste method described above. In the aluminum hot spray method aluminum is sprayed on the surfaces of the ceramic article, surfaces 13 and 14 of FIG. 1 for example, to expedite adherence of the aluminum to the surfaces.

Figure 2:
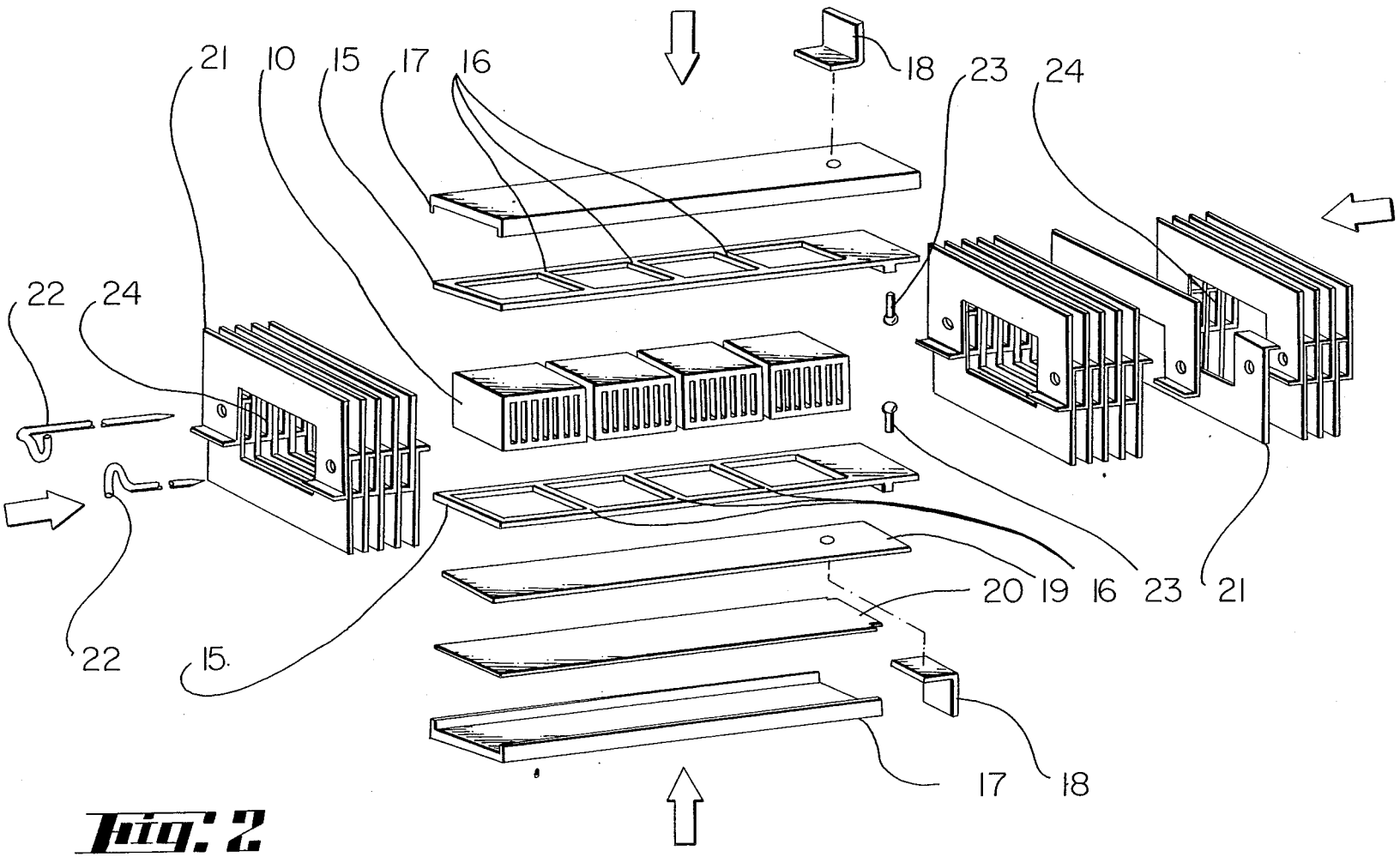
FIG. 2 is an exploded view of a heater using the heating element of the instant invention.

A method of preparing a heater utilizing the heating elements comprising a PTC ceramic article in building block form from the described with reference to FIG. 2. In this method four of the heating elements 10 prepared by the method described above were used. Insulated plastic frames 15 were positioned above and below heating elements 10. In these frames spacers 16 were provided to separate the ceramic heating elements 10. An aluminum channel frame 17 was positioned at the top of the heater and the terminal 18 was attached thereto. A copper plate 19 was positioned below the lower insulated plastic frame 15 an an insulation paper 20 was positioned between the copper plate 19 and the lower aluminum channel frame member 17. A terminal 18 was attached to the copper plate 19. The terminals were attached by means of a rivets 23. Aluminum fins 21 were positioned over the completed heating element. The heating element was positioned in the aperture 24 in the aluminum fin structure. The fins were held in place by lock pins 22.

Obviously many modifications and variations of the invention may be made without departing from the essence and scope thereof only limitations should be applied as are indicated in the appended claims.

What is claimed is:

1. A heating element consisting essentially of:

a rigid rectangular structural body having a top surface and a bottom surface, a front and a back surface, and two ends, said rigid rectangular structural body consisting of ceramic material having a positive temperature coefficient of resistance, said rigid rectangular structural body having a plurality of substantially uniform parallel rectangular channels through the body from the front to the back surfaces thereof, each of said channels being separated by a partition wall of substantially uniform thickness, said rigid rectangular structural body having electrodes affixed to the top and bottom surfaces thereof, and in electrical contact therewith.

2. A process for preparing a rigid compact resistor device of general rectangular configuration having a series of parallel channels therethrough said channels comprising about 40 percent of the total volume of said resistor comprising the steps of:

(a) preparing a slurry of a ceramic powder of barium titanate, a solvent and a binder, (b) spray drying said slurry to prepare granules, (c) pressing said granules into the form of said rectangular device, (d) sintering at a temperature of 1000°-1450° C., (e) coating oppositely disposed surfaces of said rectangular device with ohmic electrodes and sintering to 500° to 900° C., and (f) recovering the rigid compact resistor device, 3. The process according to claim 2 wherein the ohmic electrodes are applied as a silver paste, the paste is dried and the resistor device heated to a temperature of 500° to 900° C.

4. The process according to claim 2 wherein the ohmic electrodes are applied by spraying hot aluminum metal on the oppositely disposed surfaces.

5. An air heater structure prepared by the method consisting of (a) positioning a plurality of heating elements prepared by the method of claim 2 on upper and lower electrically non-conductive insulated plastic frames, (b) positioning an aluminum channel frame having a terminal attached thereto on the upper surface of the heating elements, (c) positioning a copper plate having a terminal attached thereto below the lower non-electrically conductive plastic frame, (d) positioning a insulation material below the copper plate, (e) attaching an aluminum channel frame to the lower surface, (f) attaching a plurality of heat conducting fins normals to the structure.

* * * * *